US006938391B1

(12) United States Patent
Patel

(10) Patent No.: US 6,938,391 B1
(45) Date of Patent: Sep. 6, 2005

(54) STRUCTURAL MEMBER

(76) Inventor: Sandeep N. Patel, 15415 Autumn Sky La., Houston, TX (US) 77095

( * ) Notice: Subject to any disclaimer, the term of this patent is extended or adjusted under 35 U.S.C. 154(b) by 0 days.

(21) Appl. No.: 10/442,798

(22) Filed: May 21, 2003

Related U.S. Application Data

(60) Provisional application No. 60/451,155, filed on Feb. 28, 2003, provisional application No. 60/382,641, filed on May 23, 2002.

(51) Int. Cl.[7] ..... E04C 3/30

(52) U.S. Cl. ..... 52/730.1; 52/730.6; 52/731.7

(58) Field of Search ..... 52/730.1, 726.2, 52/726.3, 729.5, 731.7, 730.6, 732.1, 737.1

(56) References Cited

U.S. PATENT DOCUMENTS

| | | | | |
|---|---|---|---|---|
| 383,343 | A * | 5/1888 | Coker | 52/730.1 X |
| 3,385,015 | A * | 5/1968 | Hadley | 52/729.5 X |
| 6,000,190 | A * | 12/1999 | Richardson | 52/731.7 |
| 6,131,362 | A * | 10/2000 | Buecker | 52/737.1 |

* cited by examiner

*Primary Examiner*—Anthony D. Barfield
(74) *Attorney, Agent, or Firm*—E. Randall Smith

(57) ABSTRACT

A structural member includes at least three webs each having first and second sides, and at least three flanges. A flange is disposed along the second side of each web. The webs are arranged so that their first sides are located adjacent to one another and their second sides are spaced apart from one another. At least one web may include a plurality of cut-out portions to form castellations in the structural member.

22 Claims, 5 Drawing Sheets

STRUCTURAL MEMBER

This application claims the benefit of U.S. Provisional Application Ser. No. 60/382,641 filed May 23, 2002 and entitled Construction Material, Apparatus, Methods and Applications, and U.S. Provisional Application Ser. No. 60/451,155 filed Feb. 28, 2003 and entitled Construction Material, Apparatus, Methods and Applications.

BACKGROUND OF THE INVENTION

The invention relates to an improved structural member, methods for the manufacture and assembly thereof and applications therefor.

In the construction of new structures and the repair, reinforcement or other modification of existing structures, the project design requirements and cost factors typically limit, or determine, the types of materials that are used. Some of the design factors that may affect the decision as to what type of materials or construction members to use include member sectional properties, material strength, capacity, stiffness and wind resistance. Cost factors typically include the cost of materials, assembly, transportation and erection. Presently, there are few options for construction members that can meet a wide range of design requirements and still be cost effective.

Thus, in considering existing technology for construction materials, there remains a need for structural members, methods for the manufacture and assembly thereof and applications therefor having one or more of the following attributes, capabilities or features: allowing great flexibility in the design of a structure; allowing great flexibility in the design of a vertical or horizontal structure at an economic cost; possessing sufficient stiffness to prevent deflection thereof; having greater stiffness and/or significant strength along numerous or all of its axes; a three-dimensional structural member, such as having a triangular cross section or cruciform shape; a three-dimensional structural member, such as having a Y or cruciform shape; a structural member having increased sectional strength and capacity; a structural member constructed at least partially of very strong material without substantial increased cost; a castellated structural member useful in tower applications and having reduced wind force on the tower; a tower having members, such as end plates, behind which co-axial cables for antennas, or other devices, that are attached to or associated with the tower can be located and isolated from wind; a tower or tower component having improved sectional properties (such as resistance against bending) without substantially increasing weight, cost and/or added wind load; a structural member that is easy to assemble and erect, and/or can be assembled on site or in advance; methods of connecting and erecting multiple sections of a structure, such as a tower, that are simple and quick; methods and apparatus for easily and effectively increasing the strength and/or capacity of a structure without increasing wind load; cost-effective, simple and/or quick methods of new construction and/or the upgrade, modification, repair, strengthening, retrofitting, reinforcing, or increasing the strength of pre-existing structures; increasing the strength of a structural member with cover plating; retrofitting or modifying existing components or structures to achieve any of the above.

BRIEF SUMMARY OF THE INVENTION

In various embodiments, the present invention involves a structural member havingat least three webs and at least three flanges. The webs each have first and second sides and are arranged so that the first sides are located adjacent to one another and the second sides are spaced apart from one another. Each flange extending from a different web along the second side of the web.

The webs may be at least partially connected together along the first sides thereof and may be arranged in a generally Y-shape configuration. The structural member may be useful in vertical structure applications and/or horizontal structure applications. One or more flange and/or web may be at least partially hollow or at least partially solid, formed of at least one layer of material, constructed of at least one among steel, wood, aluminum and concrete, formed by at least one among the processes of pouring, pre-casting and formation-in-place, formed in the shape of at least one among square, rectangular, tubular, round and truss-shaped, or any combination thereof.

In some embodiments, the present invention involves a structural member including at least one web having a plurality of openings disposed between the first and second ends thereof. Each web may include a plurality of openings. Each plurality of openings of each web may intersect at least one opening of an adjacent web, the intersecting openings of adjacent the webs forming a group of the openings. Each group of openings may form a castellation in the structural member. Each castellation may have a maximum length of between approximately 3 feet and approximately 6 feet and a maximum width of between approximately 1½ feet and approximately 4½ feet. At least one castellation may have a hexagonal shape.

Certain embodiments of the present invention involve a method for forming a structural member with the use of at least two elongated members, each elongated member having a body portion. The method includes cutting the body portion of each elongated member along its length along an at least partially non-linear path to form two separate elongated member portions therefrom. Each elongated member portion includes a non-linear side edge having a plurality of protrusions and a plurality of cut-outs along its length. The non-linear side edges of at least three elongated member portions are aligned so that at least one protrusion of each such elongated member portion is adjacent to a protrusion of the other such elongated member portions. The at least three elongated member portions are at least partially connected at the adjacent protrusions.

The method of such embodiments may also include connecting three elongated member portions to form a structural member having a generally Y-shaped cross section. At least two elongated members may be constructed of steel and may be cut with the use of a torch. The elongated member portions may be connected by welding.

The structural member may have a depth that is greater than the depth of each of the elongated members. The structural member may have a depth that is approximately 1.5 times the depth of each elongated member. At least one cut-out of each of the at least partially connected elongated member portions may be aligned with a cut-out of the other such at least partially connected elongated members portions, such aligned cut-outs forming a castellation in the structural member. At least one castellation may have has a hexagonal shape.

Various embodiments of the invention involve a method for forming a structural member having at least three webs and at least three flanges, each web having first and second sides, the method including arranging the at least three webs so that their first sides are located adjacent to one another and their second sides are spaced apart from one another and arranging the at least three webs so that a flange extends from each web along the second side thereof. The webs may be arranged in a generally Y-shaped configuration. A plurality of openings may be formed in each of the webs between its respective first and second ends. At least some of the openings of the webs may form castellations in the structural member. Each castellation may have a maximum length of between approximately 3 feet and approximately 6 feet and a maximum width of between approximately 1½ feet and approximately 4½ feet.

Accordingly, the present invention includes features and advantages which are believed to enable it to advance structural member technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS

Figure 1:
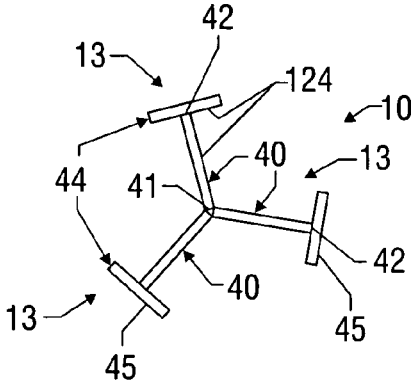
FIG. 1 is an end view of an embodiment of a three-webbed structural member in accordance with the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof are not intended to mean the claimed invention of any particular patent claim or claims, or all of the appended claims. The subject or topic of each such reference is thus not necessarily part of, or required by, any particular claim(s) merely because of such reference and mention herein.

Each of the following U.S. patent applications are hereby incorporated by reference herein in their entireties:

a. U.S. Provisional Application Ser. No. 60/382,641 filed May 23, 2002 and entitled Construction Material, Apparatus, Methods and Applications; and b. U.S. Provisional Application Ser. No. 60/451,155 filed Feb. 28, 2003 and entitled Construction Material, Apparatus, Methods and Applications.

Referring initially to FIG. 1, in one independent aspect, the present invention is an improved structural member 10 having at least three stems, or webs, 40 and at least three flanges 44. Each web 40 has a first side 41 and a second side 42. The webs 40 are arranged so that their first sides 41 are located adjacent to one another and their second sides 42 are spaced apart from one another. If desired, the webs 40 may be connected together directly or indirectly, at least partially, at their first sides 41 in any suitable manner. In a preferred embodiment, the webs 40 are connected together by weld along the length of their first sides 41. A flange 44 extends from each web 40 along its second side 42.

The structural member 10 can be formed in any manner, using any techniques or methods. For example, the structural member 10 may be prefabricated or cast, formed as a single integral unit, or constructed from plates or sheets of any desired material or combination of materials, such as steel, aluminum and wood. For another example, two or more I-beams may be cut to form the structural member 10.

Figure 2:
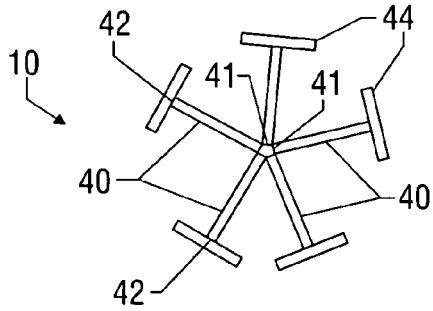
FIG. 2 is an end view of an embodiment of a five-webbed structural member in accordance with the present invention.

FIG. 1 shows an example of a "three-webbed" structural member 10, while FIG. 2 provides an example of a "five-webbed" structural member 10. The webs 40 of a three-webbed structural member 10 are shown arranged to generally form a Y-shape, although this arrangement is not required. As used herein and in the appended claims, the term "Y-shape" means three webs of a structural member arranged so that their cross-sectional shape, or configuration, is in the general shape of a "Y". However, the distances or angles between the adjacent webs is not limited to forming a "Y" shape. For example, each web 40 in a "Y-shape" arrangement may be equidistant from the adjacent webs 40.

The webs 40 and flanges may have any desired size, shape, form, material construction, configuration that has, or provides, structural strength. For example, without limitation, the webs 40 and/or the flanges 44 may be entirely or partially solid or hollow; square, rectangular, tubular, round, truss-shaped; be formed of a single layer or multiple layers of material; be constructed from sheets or plates, steel, wood, aluminum, concrete, other material or composite, and may be welded together, poured or formed in place or pre-cast, or any desired combination thereof.

Figure 3:
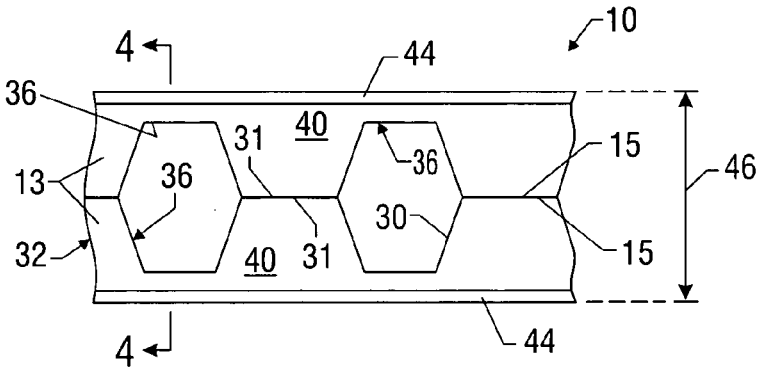
FIG. 3 is a partial side view of an embodiment of a castellated member in accordance with the present invention.
Figure 4:
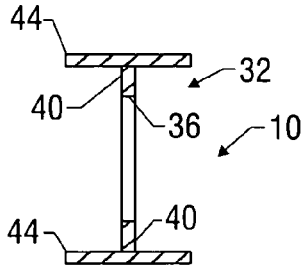
FIG. 4 is a cross-sectional view of the castellated member of FIG. 3 taken along line 4—4.

Referring now to FIGS. 3 and 4, in another independent aspect, the present invention involves a structural member 10 having a plurality of castellations 36. This type of structural member 10 is referred to herein as a castellated member 32. Because the castellated member 32 is a type of structural member 10, the description herein with respect to the structural member 10 also applies to the castellated member 32.

The castellated member 32 may have any desired dimensions, and any desired number, size, shape, configuration and arrangement of castellations 36. In the embodiment shown, the castellated member 32 has a length of approximately 20 feet and between four and five castellations 36. The illustrated exemplary castellations 36 are hexagonal in shape and have a maximum length of between approximately 3–6 feet (preferably 4–5 feet) and a maximum width of between approximately 1½ feet–4½ feet (preferably 2½–3½ feet).

Figure 5:
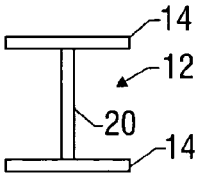
FIG. 5 is an end view of an example elongated member that may be used in an embodiment method for forming a castellated member in accordance with the present invention.
Figure 6:
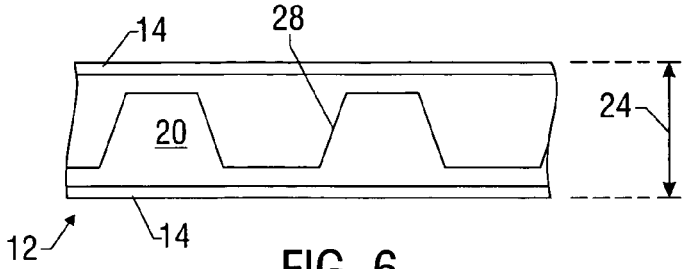
FIG. 6 is a partial side view of the elongated member of FIG. 5 showing a cut line formed in the elongated member in accordance with an embodiment method for forming a castellated member in accordance with the present invention.
Figure 7:
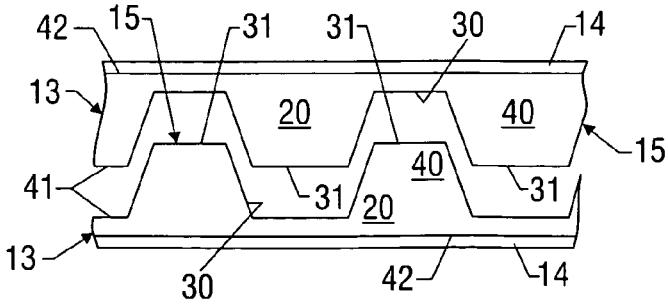
FIG. 7 is a partial side view of the elongated member of FIG. 5 shown being separated into two elongated member portions during an embodiment method for forming a castellated member in accordance with the present invention.

FIGS. 5–7 illustrate an example method for forming a castellated member 32 using elongate members 12. Each elongated member 12 (FIG. 5) is an I-beam having a body portion 20 and a pair of opposing flange portions 14. The elongated member 12 and its body portion 20 and flange portions 14 can have any desired or suitable shape, form, configuration and size, and may be constructed of any desired material. Moreover, the present invention is in no way limited by the form, configuration, parts, material make-up and other features of the elongated member 12. For example, the elongated member 12 may not include flange portions 14.

Referring to FIG. 6, the body portion 20 is cut, such as along a cut line 28, and separated into two separate elongated portions 13. If the elongated member 12 is steel, for example, a torch can be used for cutting the elongated member 12. However, the present invention is not limited to the cut line 28. The elongated member 12 can be cut along any desired path or paths, in any desired manner and with any suitable equipment. Referring to FIG. 7, each elongated portion 13 thus has numerous openings, or cut-outs, 30 and numerous protrusions 31 at least partially along its first side 15. This process can be performed to create numerous elongated portions 13, if desired.

Referring back to FIGS. 3 and 4, in this example, numerous elongated portions 13 are realigned so that at least some of their respective openings 30 are adjacent. The portions 13 are then connected to one another along at least some of their respective protrusions 31 to form a castellated member 32. Each castellation 36 is thus formed from at least two adjacent intersecting openings 30. Accordingly, a three-webbed castellated member (not shown) will have the respective openings of three elongated portions aligned to form groups of three adjacent intersecting openings and corresponding groups of three adjacent intersecting protrusions. Any suitable method and equipment may be used for connecting the portions 13. For example, if the portions 13 are steel, they may be connected by welding.

It should be understood that the present invention is not limited to connecting elongated portions 13 that have been separated from a common elongated member 12. For example, two three-webbed castellated members 32 may be formed from three elongated members 12. Moreover, any suitable elongated portions or other components may be connected, formed or cast to create a castellated member 32.

If desired, the castellated member 32 may be formed so that its depth 46 (FIG. 3) is greater than the depth 24 of the elongated member 12 (FIGS. 5, 6). For example, the illustrated elongated member 12 may have a depth 24 of approximately 12", while the depth 46 of the illustrated castellated member 32 is 16", or 1½ times the depth 24 of the elongated member 12. However, the castellated member 32 can be formed with any desired depth 46.

In yet another independent aspect of the invention, the structural member 10 and/or castellated member 32 may be used as a structure or part of a structure, or as a construction or building member or material in any desired application. As used herein and in the appended claims, the term "structure" includes a vertical structure, such as a column, tower or tower leg, a cantilevered member, a flexural member or structure, and a horizontal structure, such as a beam and girder.

The structure may be pre-assembled or constructed on site, and may have any desired quantity, configuration and orientation of structural members and/or castellated members. The structure may be at least partially concealed, such as in a "stealth" technology application, or as a structural "backbone" for aesthetic purposes. The dimensions, material construction and configuration of the structural member(s) 10 and/or castellated members 32 may be selected to optimize performance, such as to achieve the desired strength and capacity of the structure, provide (significant) stiffness to prevent (significant) deflection, reduce wind force upon the structure, weight, cost, other factors, or any combination thereof. However, the present invention does not necessarily require any of the above characteristics or capabilities.

One or more structural member 10 and/or castellated member 32 may, for example, be used in the construction or reinforcement of a tower, such as a communication or antenna tower. The tower may be cantilevered, oriented straight, tapered or non-tapered. The tower may be a self-supported monopole guy-wired tower or any other type of tower. When constructed with one or more structural member or castellated member of the present invention, the tower may be stiffer than existing towers, causing less deflection and movement and, for guy-wired towers, may have its wires spaced farther apart than existing towers. If desired, the tower can taper from bottom to top to increase material cost savings and improve aesthetic appearance and/or the tower may be constructed with less material than existing towers.

With the use of the structural member and/or castellated member of the present invention, there is greater flexibility in the type of material utilized. For example, the webs 40 may be constructed of lower-grade lighter material, providing cost savings while not substantially reducing strength or capacity. However, the present invention does not necessarily require any of the above features or applications.

Figure 8:
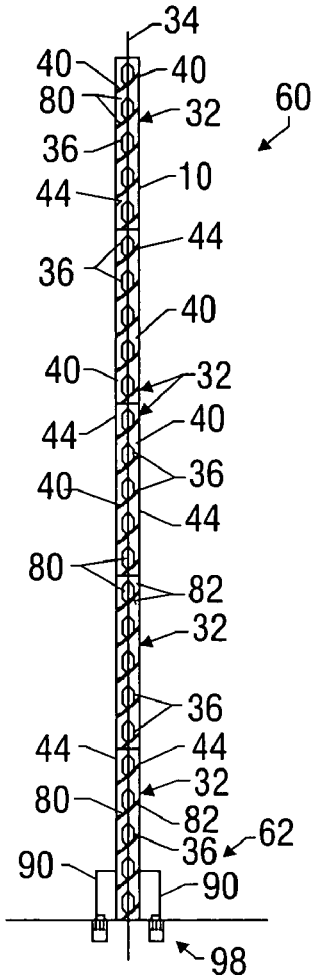
FIG. 8 is a front elevation view of an example column incorporating an embodiment of a castellated member in accordance with the present invention.
Figure 9:
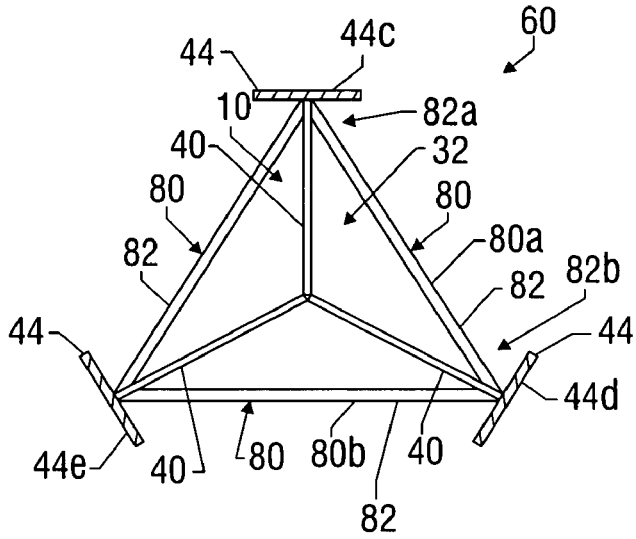
FIG. 9 is a partial cross sectional view of a structure incorporating an embodiment of a structural member and an embodiment of bracing in accordance with the present invention.

In one example application, referring to the embodiment of FIGS. 8 and 9, a column 60 is shown including numerous 3-armed castellated members 32 connected axially, or end-to-end, along centerline 34. In this example, each castellated member 32 has a plurality of castellations 36 along its height. The column 60 may be used, for example, as a tower or tower component, such as a tower leg.

Figure 10:
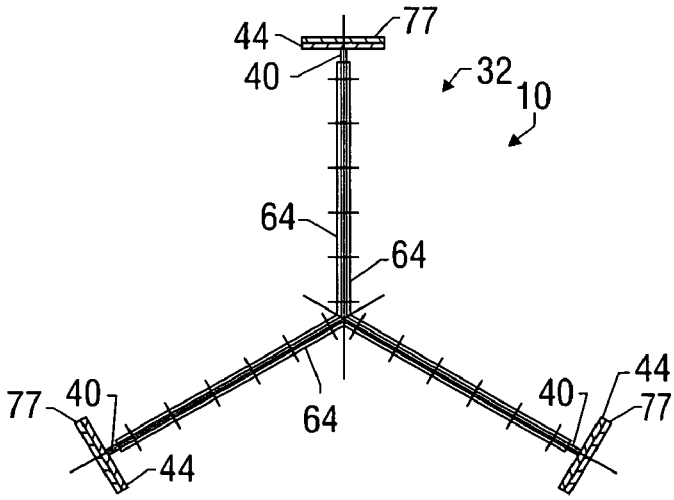
FIG. 10 is a partial cross sectional view of a structure incorporating an embodiment of a structural member and embodiments of bent connector plates and support plates in accordance with the present invention.
Figure 11:
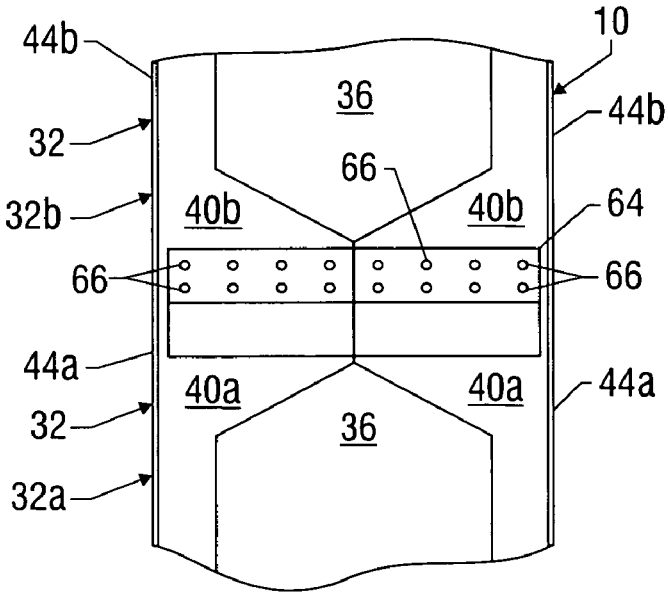
FIG. 11 is an isolated view of a structure incorporating an embodiment of a structural member and an embodiment of a bent connector plate in accordance with the present invention.
Figure 12:
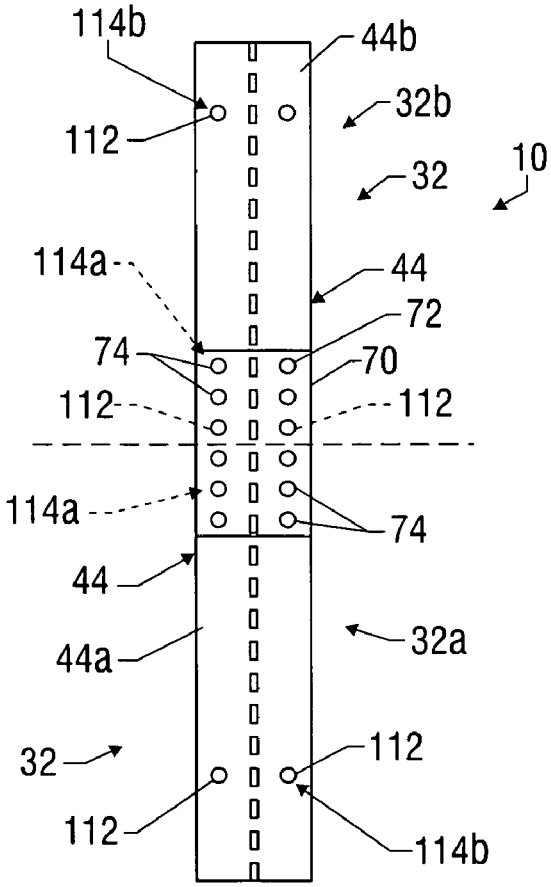
FIG. 12 is an isolated view of a structure incorporating an embodiment of a structural member and an embodiment of flange connector plates in accordance with the present invention.

The castellated members 32 of a structure may be connected in any suitable manner and with any suitable components. In the embodiment of FIGS. 10–12, for example, the webs 40 of adjacent castellated members 32 are connected with bent connector plates 64 and the flanges 44 of adjacent castellated members are connected with flange connector plates 70.

Referring to FIG. 11, a lower (3-armed) castellated member 32*a* includes three webs 40*a* (FIG. 10) spaced apart approximately 120 degrees, and three corresponding flanges 44*a*. Similarly, an upper (3-armed) castellated member 32*b* includes three webs 40*b* and three flanges 44*b*. Each axially aligned set of webs 40*a*, 40*b* of this embodiment is connected with a bent connector plate 64. The bent connector plates 64 can take any desired form, construction and configuration, and can be made of any desired material, such as the materials suggested above for the webs 40.

In this example, three bent connector plates 64 are used at each splice, or joint, of axially aligned adjacent castellated members 32. Each plate 64 has a 120 degree bend and is engageable with two adjacent webs 40*a* of the lower castellated member 32*a* and the two axially aligned webs 40*b* of the upper castellated member 32*b*. The bent connector plates 64 can be connected with any suitable technique and components. For example, the bent connector plate 64 of FIG. 11 is welded to the lower castellated member 32*a* and connected with bolts 66 to the upper castellated member 32*b*. However, the plates 64 can be welded, or bolted, to each castellated member 32*a* and 32*b*, or connected in another suitable manner. Further, any other suitable quantity of bent connector plates 64 may be used, and the plates 64 need not be connected in the above manner or configuration. In other embodiments, flat plates (not shown) may instead be used to connect the webs 40 of axially aligned structural members 10 and/or castellated members 32.

Now referring to FIG. 12, the flanges 44 of the illustrated axially aligned adjacent castellated members 32 are shown connected with flange connector plates 70. In this example, a plate 70 is engaged between each flange 44*a* of the lower castellated member 32*a* and the corresponding aligned flange 44*b* of the upper castellated member 32*b*.

The flange connector plates 70 can take any suitable shape, form, construction and configuration, and can be made of any desired material. Further, the plates 70 can be connected to the flanges 44 in any desired manner (weld, mechanical connectors, etc.) and with any components. For example, the flange connector plates 70 shown in FIG. 12 are solid, flat, rectangular metal plates having the same width (such as 8 inches) and thickness (such as ¼–1½ inch) as the flanges 44, and are connected to the upper and lower flanges 44*a*, 44*b* with bolts 74.

The above examples of components and techniques for connecting multiple structural members 10 and/or castellated members 32 may provide various benefits including ease of installation and erection, being performed on the ground or in the air and eliminating the need for other erection procedures, or a combination thereof. However, the webs 40 and/or flanges 44 of axially aligned structural members 10 and/or castellated members 32 can be connected with any other suitable components or technique.

Figure 13:
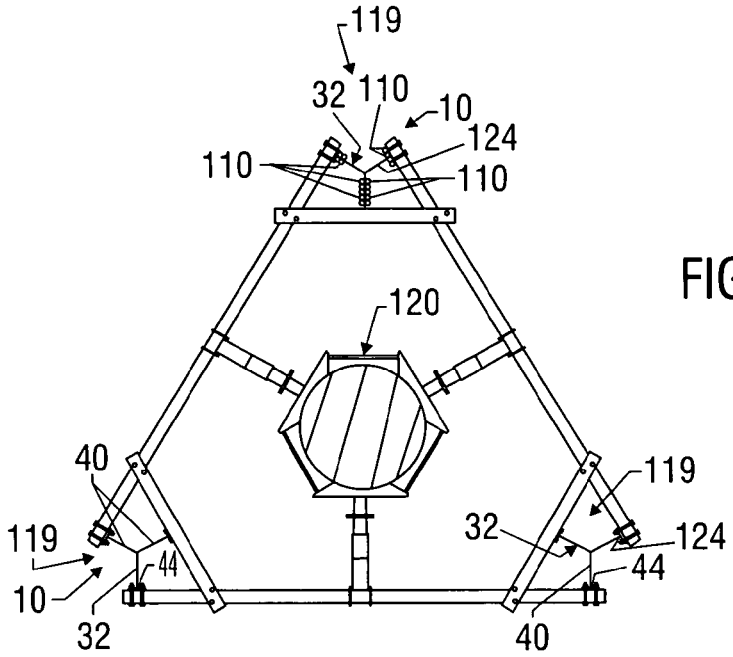
FIG. 13 is a partial cross sectional view of a tower having three attached columns incorporating an embodiment of a structural members n accordance with the present invention.

FIG. 13 shows an example use of castellated members 32 as structures attached to a monopole tower 120 for reinforcing the tower 120. In this example, three vertical elements 119 constructed of castellated members 32 are added to the tower 120 to transfer force out of the tower 120. If desired, the vertical elements 119 may be not be included along the entire height of the tower 120 to achieve the desired reinforcement or increased capacity. For example, the vertical elements 119 may only need to extend to a height of 35–40% of the tower height to achieve the desired results.

In yet another independent aspect of the invention, it may be desirable to use bracing in conjunction with the structural members 10 and/or castellated members 32 to maintain stability thereof, or for any other desirable reason. In the embodiment of FIGS. 8 and 9, for example, a plurality of braces 80 is included on the column 60. In this example, a brace 80 extends between each adjacent flange 44 of each respective castellated member 32 (FIG. 9) at approximate 5 foot increments along the height of the column 60 (FIG. 8). The braces 80 are shown diagonally oriented (FIG. 8).

If desired, at least two of the braces 80 associated with a particular castellated member 32 can be arranged end-to-end. For example, referring to FIG. 9, the first brace 80*a* extends downwardly at approximately 45 degrees from the first flange 44*c* to the second flange 44*d*, while the second brace 80*b* extends upwardly at approximately 45 degrees from the second flange 44*d* to the third flange 44*e*. Thus, the respective ends of the brace 80*a* and 80*b* that are adjacent to the second flange 44*d* are end-to-end.

The example braces 80 shown in FIG. 9 are 1" diameter metal rods 82. Each end 82*a*, 82*b* of each illustrated rod 82 is beveled to engage the castellated member 32 at the intersection of a flange 44 and a web 40. The metal rods 82 are attached to the respective castellated members 32 by weld. In the example embodiment of FIGS. 15–18, the braces 80 are connected to flanges 44 with the use of brace connection plates 84. Any other suitable connection mechanisms or technique may instead be used.

However, if bracing is included, it need not take the forms or configurations described above. For example, the braces 80 may not be metal rods 82 arranged as described above, but can be any suitable bracing component(s) having any desired shape, configuration and form, constructed of any desired material and arranged in any desired configuration, such as X-bracing, Z-bracing or K-bracing configurations.

In another independent aspect of the invention, a structure having support members 10 and/or castellated members 32 may be supported at its base in any suitable manner, if desired. For example, the column 60 of FIG. 8 is shown supported at its base 62 with stub columns 90. In this particular embodiment, three stub columns 90 are included, each being steel and having an "I-beam" configuration. To support a column 60 that is about 250 feet in length, for example, each stub column may have a length of approximately 6 feet and a depth 91 of approximately 3 feet. However, the stub column 90 is not limited to any of these details; the stub column 90 can have any desirable suitable size, material construction, configuration, shape and form.

Figure 14:
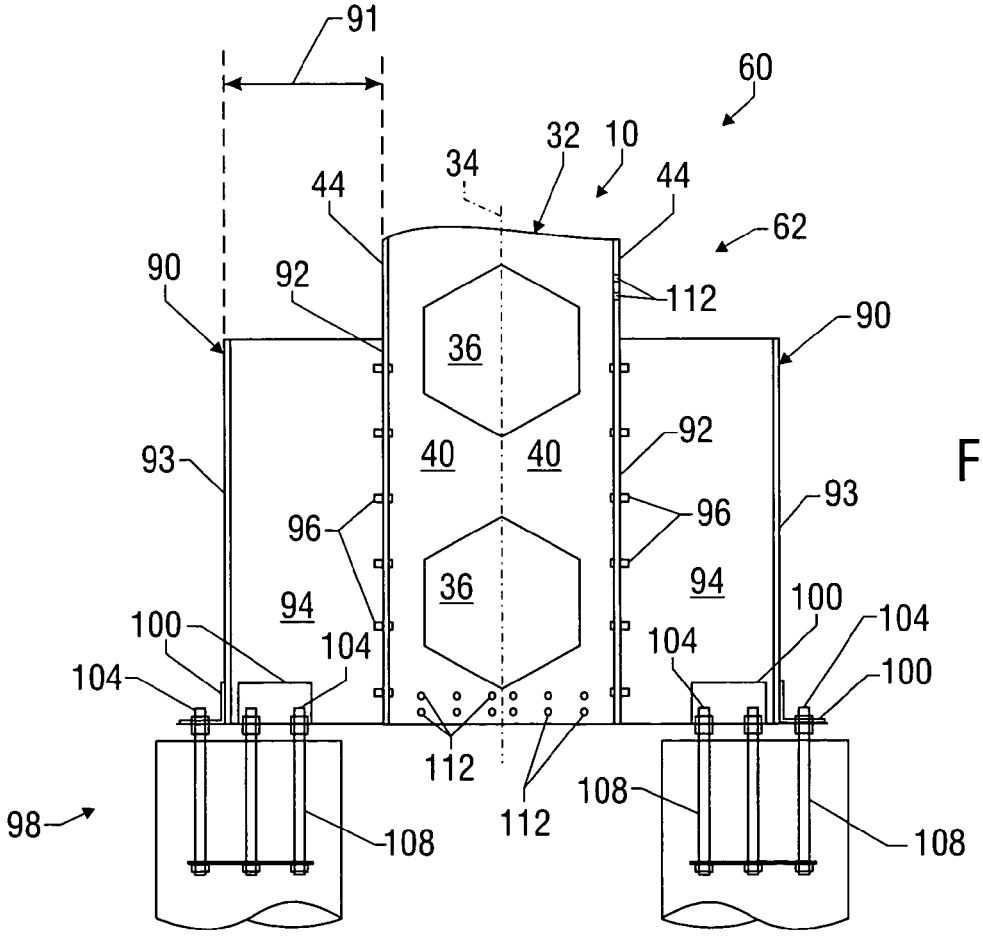
FIG. 14 is a partial side view of the lower portion of a structure incorporating an embodiment of a structural member and an embodiment of a foundation in accordance with the present invention.

In the example base support arrangement of FIG. 14, each stub column 90 is connected between the foundation 98 and a flange 44 of the "base" castellated member 32 located at the column base 62. A stub flange 92 of each stub column 90 is connected, such as by bolt 96 or weld to a flange 44 of the base castellated member 32. Another part (or parts) of each stub column 90, such as a stub flange 93, is connected to the foundation 98. In the embodiment shown, both the stub flange 93 and stub web 94 are connected to the foundation 98 with L-shaped plates 100 and anchor bolts 104.

In yet another independent aspect of the present invention, the foundation 98 can be any suitable foundation. For example, the foundation 98 can include one or more concrete footer and one or more shaft, or pier, 108. The shafts 108 may serve as, or engage, the anchor bolts 104, and may extend underground any desired depth. For example, for a column 60 having a height of 250 feet, the shafts may extend underground approximately 30 feet. Locating the shafts 108 under the flanges 44 may, for example, assist in ease of construction and be cost effective.

In even a further independent aspect of the invention, the structural member(s) 10 and/or castellated member(s) 32 of the present invention can include one or more upgrade adapters. Upgrade adapters can be included for flexibly, easily, quickly and/or efficiently improving the strength of the support or castellated member, or any other desired reason(s). If one or more structural or castellated member is used as a flexural member, column, tower or part of a column or tower, for example, the capacity of the column or tower may be increased by connecting one or more support member to the upgrade adapter(s), and, if desired, without increasing wind load on the column. For example, referring to FIGS. 12 and 14, one or more flange 44 (FIG. 12) or web 40 (FIG. 14) of the castellated member 32, or a combination thereof, can be formed having one or more upgrade adapters 112 to which a support member (e.g. support plate 77, FIG. 10) may be connected.

The upgrade adapters 112 can have any desired form, construction, and configuration. In the example of FIG. 12, the illustrated flanges 44 of the castellated members 32 are shown having first and second pluralities of anchor holes 114*a*, 114*b*. The flange connector plates 70 are shown having a series of passages 72 aligned with the first plurality of anchor holes 114*a* of each castellated member 32. In connecting the flange connector plate 70 to the members 32, only some of the first pluralities of anchor holes 114*a* and corresponding passages 72 may be engaged, such as with bolts 74. The unused anchor holes 114*a* and passages 72 can be used to connect a second connector plate or another device (not shown) to the castellated member 32 atop the flange connector plate 70, such as to increase the strength or capacity of the member 32 without attracting additional wind forces. In another arrangement, bolts 74 originally included in all of the first pluralities of holes 114*a* in connecting the plate 70 can be removed and replaced along with additional flange connector plate(s) (not shown).

In another example, still referring to FIG. 12, the second plurality of anchor holes 114*b* on each or either castellated member 32 can be used for attaching one or more additional flange connector plate or other device (not shown) to the member 32, such as to increase its capacity. In yet another example, the illustrated flange connector plate 70 can be replaced with a longer flange connector plate (not shown) extending between the second pluralities of anchor holes 114*b* on the respective castellated members 32, or between the first plurality of anchor holes 114*a* of one of the members 32 and the second plurality of anchor holes 114*b* of the other member 32.

In still another independent aspect of the invention, devices may be attached to a structure having one or more structural member or castellated member. As used herein and in the appended claims, the term "devices" includes appurtenances, antennas, mounting brackets, cables, wires and any other item or component that is suitable for connection to a structure. Referring to the example of FIG. 13, devices in the form of electrical wires or coaxial cables 110 are shown extending up the vertical elements 119 along the interior surface 124 of the castellated members 32. The interior surface 124 includes the surfaces of the webs 40 and the flanges 44 that are inside the flanges 44 (see e.g. FIG. 1) so that the placement of devices along the interior surface 124 does not attract significant (or possibly any) additional wind forces to the structure, such as the tower 120 of FIG. 13. In another example, referring back to FIG. 1, devices, such as antennas (not shown), may be easily connected to the outer surface 45 of one or more flange 44 of the structural or castellated member(s) 10.

Figure 15:
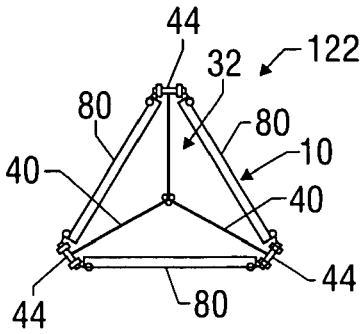
FIG. 15 is a partial cross sectional view of a structure having three faces and including an embodiment of a structural member and an embodiment of braces in accordance with the present invention.
Figure 16:
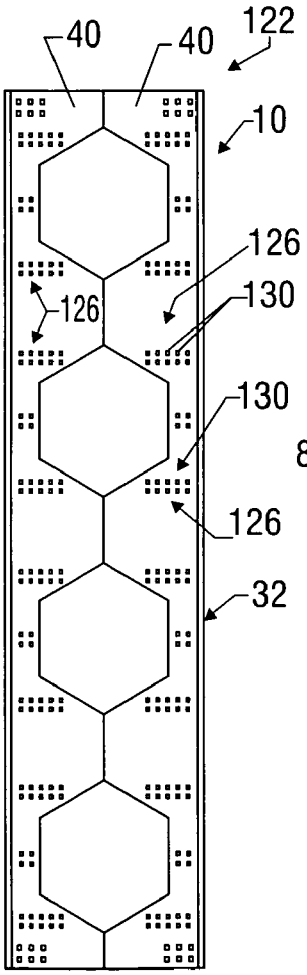
FIG. 16 is a partial elevation view of the first face of the structure of FIG. 15 showing the web portions of the exemplary structural member in isolation and having an embodiment of a device attachment adapter.
Figure 17:
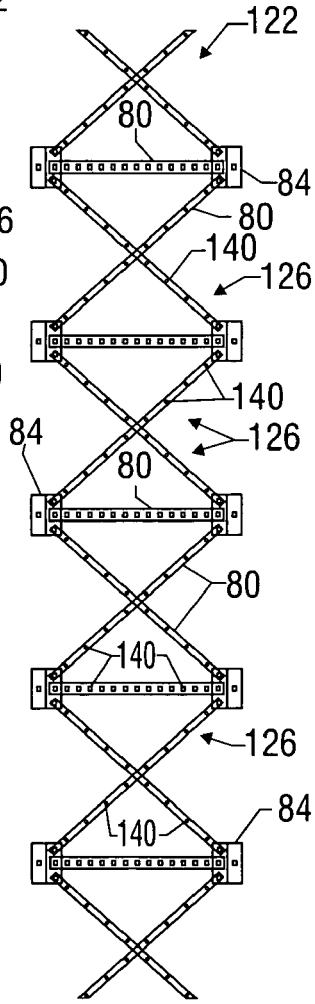
FIG. 17 is a partial elevation view of the second face of the structure of FIG. 15 showing an embodiment of X-configured braces in isolation.
Figure 18:
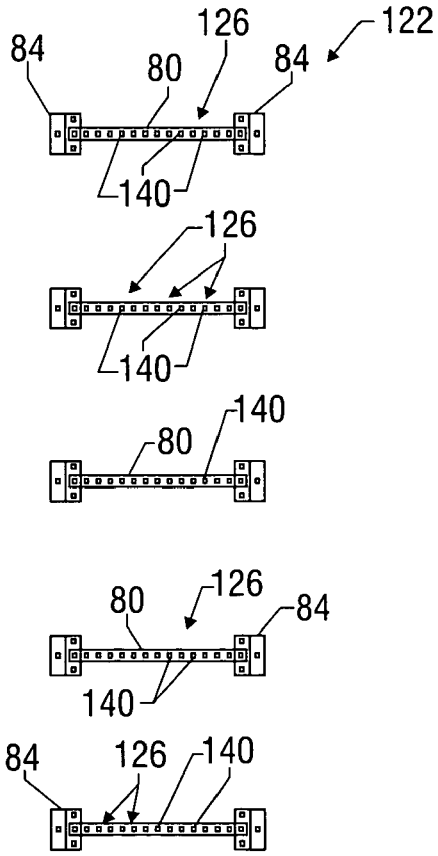
FIG. 18 is a partial elevation view of the third face of the structure of FIG. 15 showing an embodiment of horizontal braces in isolation.

In still even a further independent aspect of the invention, the structural member(s) 10 and/or castellated member(s) 32 of the present invention may include one or more device attachment adapter. Device attachment adapters can be used to easily, quickly and/or efficiently attach or remove devices to the structural member(s) 10, castellated member(s) 32 or the structure within which the member(s) 10, 32 are used. For example, FIG. 15 shows a structure 122 constructed of at least one castellated member 32. Device attachment adapters 126 are included on the webs 40 (FIG. 16) of the castellated member 32 in the form of holes 130, and on the braces 80 (FIGS. 17, 18) in the form of holes 140, for attaching one or more device (not shown) to the structure 122. In the embodiment shown, there are multiple sets of holes 130, 140 located at different vertical positions along the height of the structure 122. If the structure 122 is used for holding antennas, for example, coaxial cables associated with the antennas may be run along at least part of the height of the structure 122 and connected to the structure 122 at one or more of the holes 130, 140, such as with the use of one or more clip and bolt (not shown). If desired, the holes 130, 140 can be spaced along the height or length and width of the structure 12.

Preferred embodiments of the present invention thus offer advantages over the prior art and are well adapted to carry out one or more of the objects of the invention. However, the present invention is in no way limited to the components, configurations, dimensions, specific examples or other details described above or shown in the attached figures. Further, the above-described features are not limited to the dimensions and details as described and shown. Yet further, each such feature may be employed without any other such feature, or in any desired combination. Accordingly, the present invention does not require each of the above features or aspects and the particular combination of features described herein and shown in the appended drawings is not limiting on the present invention. The present invention includes further features, capabilities, functions, methods, uses and applications as will be apparent to a person skilled in the art based upon the description above and the appended drawings and claims.

The present invention does not require each of the techniques or acts described above and is not limited to the above-described methods. Further, the methods described above and any other methods which may fall within the scope of any of the appended claims can be performed in any desired suitable order and are thus not necessarily limited to the order described herein or as may be listed in any of the appended claims. Yet further, the methods of the present invention do not require use of the particular embodiments shown and described in the present specification, but are equally applicable with any other suitable structure, form and configuration of components.

While preferred embodiments of the invention have been shown and described, many variations, modifications and/or changes of the structural members, structures and methods of the present invention such as in the components and arrangement thereof, details of construction and operation and/or methods of use and applications, are possible, contemplated by the patentee, within the scope of the appended claims, and may be made and used by one of ordinary skill in the art without departing from the spirit or teachings of the invention and scope of appended claims. All matter herein set forth or shown in the accompanying drawings should thus be interpreted as illustrative and not limiting. Accordingly, the scope of the invention and the appended claims is not limited to the embodiments described and shown herein.

What is claimed is:

1. A structural member useful as a horizontal member, or as part of a vertical structure over approximately 25 feet in height, having strength along all of its axes and capable of supporting at least one device, the structural member comprising:

at least three webs, each of said at least three webs having first and second sides;

said at least three webs being arranged so that said first sides are located adjacent to one another and at least partially connected together and said second sides are spaced apart from one another; and at least three flanges, each said flange extending from a different said web along said second side of said web, at least one of said flanges including at least one upgrade adapter, said at least one upgrade adapter capable of releasable engagement with at least one support member, whereby the connection of the at least one support member to said at least one flange improves the strength of the structural member.

2. The structural member of claim 1 wherein said at least three webs includes three said webs arranged in a generally Y-shape configuration.

3. The structural member of claim 1 wherein the structural member is useful in vertical structure applications.

4. The structural member of claim 1 wherein the structural member is useful in horizontal structure applications.

5. The structural member of claim 1 wherein at least one among at least one said flange and at least one said web is at least partially hollow.

6. The structural member of claim 1 wherein at least one among at least one said flange and at least one said web is at least partially solid.

7. The structural member of claim 1 wherein at least one among at least one said flange and at least one said web is formed of at least one layer of material.

8. The structural member of claim 1 wherein at least one among at least one said flange and at least one said web is constructed of at least one among steel, wood, aluminum and concrete.

9. The structural member of claim 8 wherein at least one among at least one said flange and at least one said web is formed by at least one among the processes of pouring, pre-casting and formation-in-place.

10. The structural member of claim 9 wherein at least one among at least one said flange and at least one said web is formed in the shape of at least one among square, rectangular, tubular, round and truss-shaped.

11. The structural member of claim 1 wherein the structural member is used in an outdoor environment and wherein at least one among said at least three webs includes a plurality of openings disposed between said first and second ends thereof, said plurality of openings capable of reducing wind forces on the structural member.

12. A structural member useful in an outdoor environment, having strength along all of its axes and capable of supporting at least one device, the structural member comprising:

at least three webs, each of said at least three webs having first and second sides and first and second ends;

said at least three webs being arranged so that said first sides are located adjacent to one another and at least partially connected together and said second sides are spaced apart from one another;

at least one among said at least three webs having a plurality of openings disposed between said first and second ends thereof, said plurality of openings capable of reducing wind forces on the structural member; and at least three flanges, each said flange extending from a different said web along said second side of said web.

13. The structural member of claim 12 wherein each of said at least three webs includes a plurality of openings.

14. The structural member of claim 13 wherein each said plurality of openings of each said web intersects said first side of said respective web and at least one said opening of an adjacent said web, said intersecting openings of adjacent said webs forming a group of said openings.

15. The structural member of claim 14 wherein each said group of openings forms a castellation in the structural member.

16. The structural member of claim 15 wherein each said castellation has a maximum length of between approximately 3 feet and approximately 6 feet and a maximum width of between approximately 1½ feet and approximately 4½ feet.

17. The structural member of claim 15 wherein at least one said castellation has a hexagonal shape.

18. The structural member of claim 12 wherein said at least three webs includes three said webs arranged in a generally Y-shape configuration.

19. The structural member of claim 18 wherein each of said at least three webs is spaced approximately 120 degrees from its adjacent said webs.

20. The structural member of claim 12 wherein the structural member is useful in vertical structure applications.

21. The structural member of claim 12 wherein the structural member is useful in horizontal structure applications.

22. The structural member of claim 12 wherein at least one of said flanges including at least one upgrade adapter, said at least one upgrade adapter capable of releasable engagement with at least one support member, whereby the connection of the at least one support member to said at least one flange improves the strength of the structural member.

* * * * *